US006484880B1

(12) United States Patent
Shaeffer

(10) Patent No.: US 6,484,880 B1
(45) Date of Patent: Nov. 26, 2002

(54) TRANSPORTABLE CASE FOR WET/DRY ENVIRONMENTS

(76) Inventor: Jeffrey S. Shaeffer, 5473 W. Decatur, Fresno, CA (US) 93722

( * ) Notice: Subject to any disclaimer, the term of this patent is extended or adjusted under 35 U.S.C. 154(b) by 0 days.

(21) Appl. No.: 09/572,753

(22) Filed: May 16, 2000

(51) Int. Cl.[7] ..... B65D 69/00

(52) U.S. Cl. ..... 206/581; 206/823; 132/315; 220/572; 220/745; 220/752

(58) Field of Search ..... 206/581, 278, 206/77.1, 363, 823; 132/286, 315; 220/4.27, 501, 571, 572, 729, 745, 752

(56) References Cited

U.S. PATENT DOCUMENTS 4,909,384 A * 3/1990 About ..... 206/77.1
5,148,941 A * 9/1992 Chezek ..... 206/581
5,353,947 A * 10/1994 Zinnbauer et al. ..... 206/581
5,375,734 A * 12/1994 Tiramani ..... 206/581
5,787,839 A * 8/1998 Magnant et al. ..... 206/545
5,851,484 A * 12/1998 Forno et al. ..... 206/363
6,138,687 A * 10/2000 Sheffler et al. ..... 206/581
6,276,555 B1 * 8/2001 Edwards ..... 220/572

* cited by examiner

*Primary Examiner*—Luan B. Bui
(74) *Attorney, Agent, or Firm*—Marshall E. Rosenberg

(57) ABSTRACT

A transportable carrying cases for toiletries, cosmetics and personal hygiene items, for use in both wet and dry environments is disclosed. The carrying case has a main body portion with a top opening, and a perforate floor, a bottom portion configured to receive a lower portion of the main body portion in nesting or contiguous relationship, whereby excess moisture shed from articles contained in the main body portion is drained through the perforate floor into a reservoir provided in the bottom portion spaced below the perforate floor. A lid is secured in one of a plurality of telescoped positions to close the top opening of the main body portion, by a handle portion locking the lid in a closed configuration in one of a plurality of telescoped positions adjacent to the main body portion.

31 Claims, 5 Drawing Sheets

FIG. 1
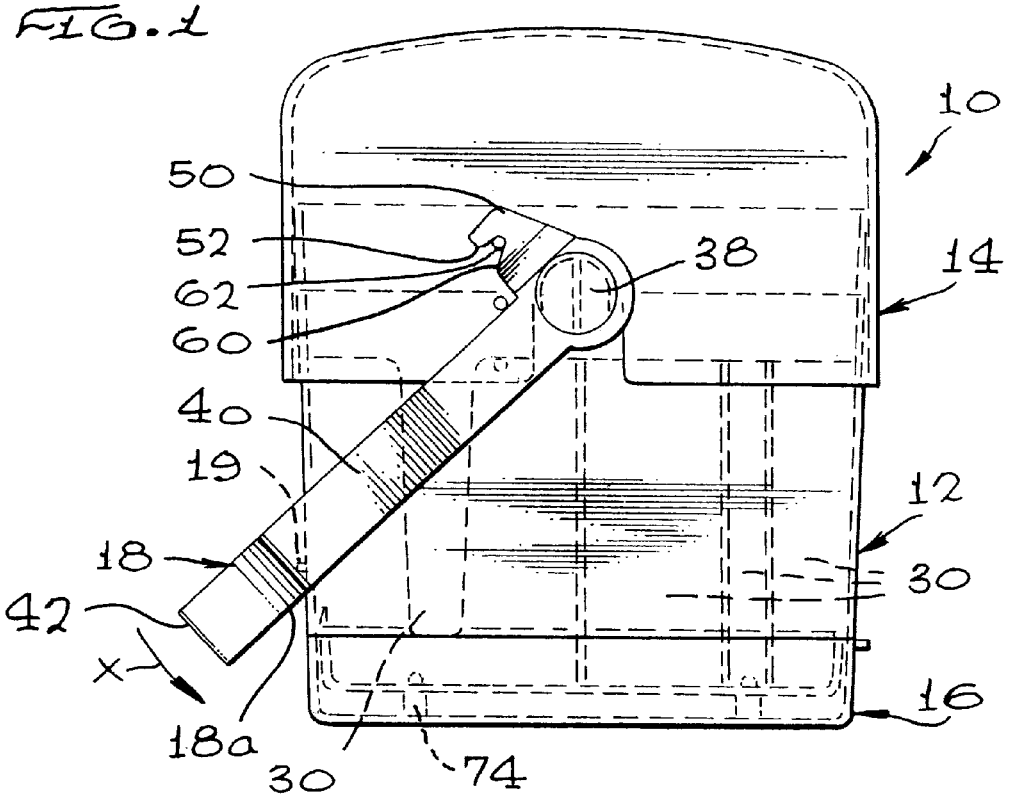
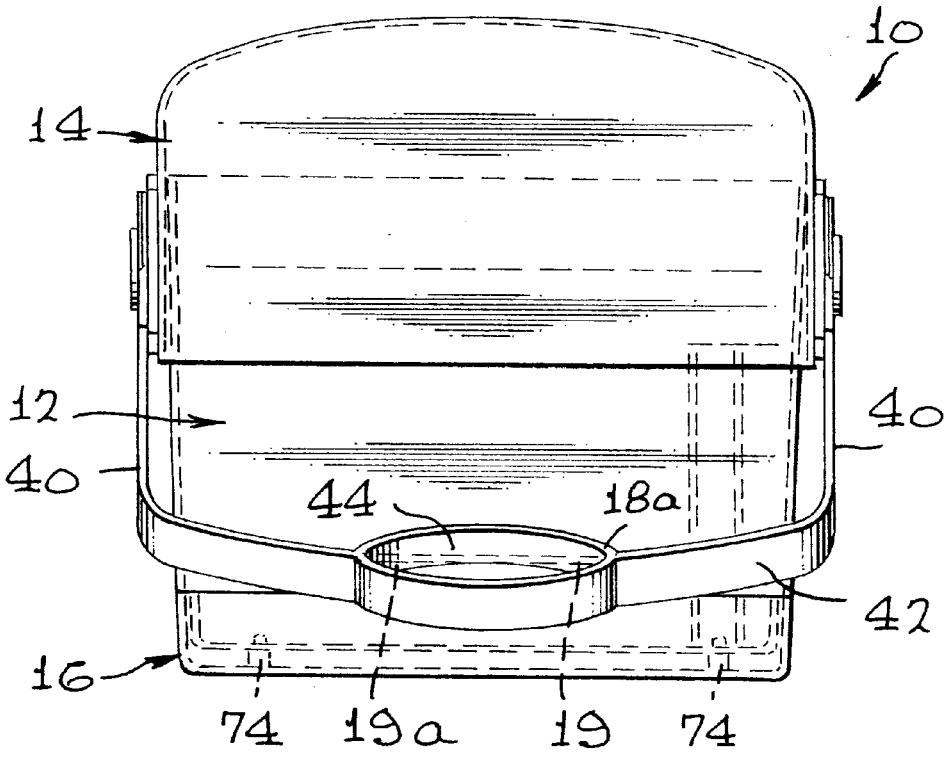
FIG. 2

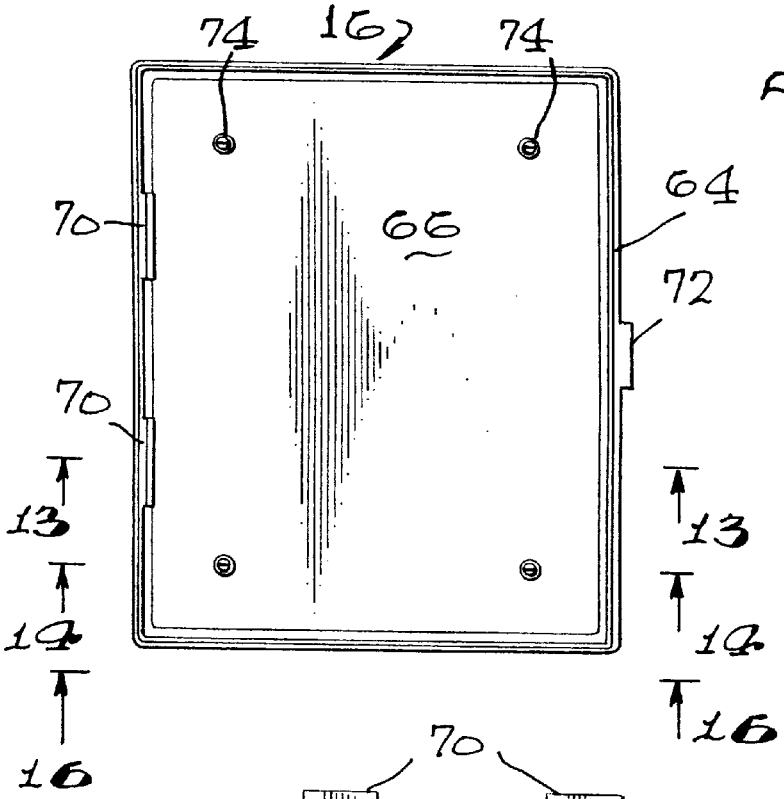
FIG. 11
FIG. 15
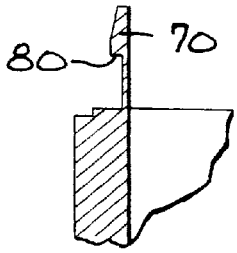
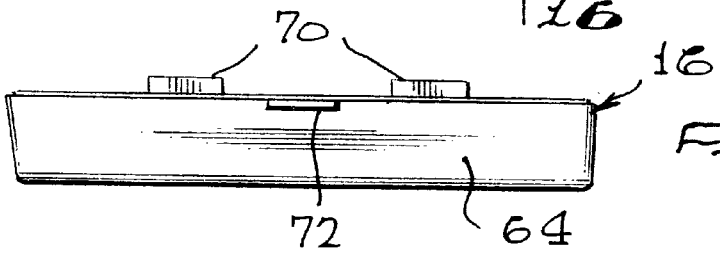
FIG. 12
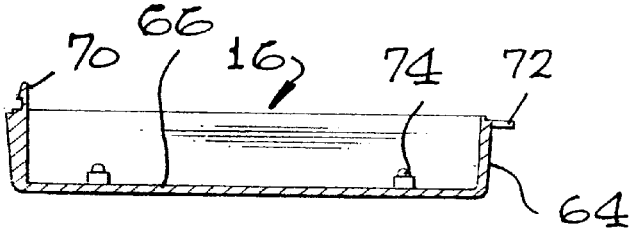
FIG. 13
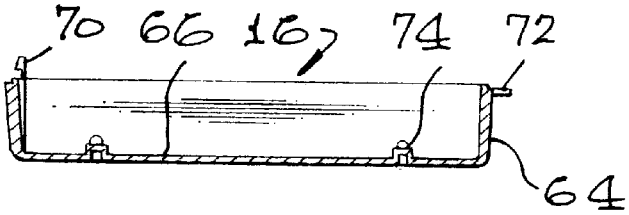
FIG. 14
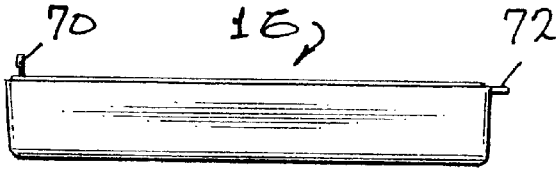
FIG. 16

TRANSPORTABLE CASE FOR WET/DRY ENVIRONMENTS

BACKGROUND OF THE INVENTION

1. Field of the Invention

The present invention relates generally to transportable carrying cases for toiletries, cosmetics, personal hygiene and other personal articles and clothing, and more particularly to a transportable carrying case for use therewith in both wet and dry environments.

2. Background of the Invention

The use of portable carrying cases for transporting toiletry, personal hygiene and other personal articles and clothing is well known in the related art. In general such portable carrying cases are designed to accommodate a random selection of toiletry or other personal hygiene items such as shampoos and conditioners, hair treatments, deodorants, shaving cream and razors, toothbrushes, toothpastes, soaps, lotions, spray containers, deodorants, and other tonics and preparations. Additionally, some portable carrying cases are known for carrying damp items resulting from use of the above-described articles, including gym clothing, towels, toiletry or other personal hygiene items, or other articles that have been exposed to a damp or wet environment but which must be transported without benefit of on-site laundering or drying before transport. Often, those portable carrying cases may provide one or more air vents as the sole means for venting some excess moisture carried and retained within the carrying cage by the damp articles. It is well known that damp environments provide fertile breeding grounds for bacterial and fungal growth , and closed or minimally air-vented containers such as related art cosmetics cases, gym bags, conventional luggage, and portable lockers fail to provide means for positive displacement of excess moisture. Thus, the related art fails to address the long felt but unsolved need to separate wet or damp items from dry items, or to allow wet or damp items to drain a residual liquid away from the other items.

Accordingly, it is desirable to provide a portable carrying case for accommodating transport of the type of articles described above, among others, especially when the articles have been dampened through use, and moreover, it is desirable to remove the dampened items from the wet environment to a dry environment in a secure case as may be used during transport between, for example, home and gymnasium. Related art carrying cases further fail to provide means for allowing expansion to accommodate an overload, within a secured carrying case, while also allowing for positive draining.

SUMMARY OF THE INVENTION

The present invention is a carrying case having a main body portion including a base with a perforate floor, a bottom portion having an imperforate floor adapted to receive in nesting relationship the base of the main body portion, the perforate floor spaced above the imperforate floor to define a reservoir therebetween for receiving drainage through the perforate floor. A lid is removably affixed to the top opening of the main body portion by a handle secured for articulation to the main body portion, the handle including a gripping device for gripping one of a plurality of securement points provided on the lid, for securing the lid in a closed configuration in one of a plurality of telescoped positions relative to the top opening when the handle is articulated to a secured position.

BRIEF DESCRIPTION OF THE DRAWINGS

FIG. 1 is a side elevational view of one embodiment of the carrying case of the present invention, showing the carrying case in a telescoped but closed and locked position.

FIG. 2 is a front elevational view of the carrying case shown in FIG. 1.

FIG. 11 is a top plan view of the bottom portion shown in FIG. 10.

FIG. 12 is a side elevational view of the bottom portion shown in FIG. 11.

FIG. 13 is a sectional view taken along line 13—13 of FIG. 11.

FIG. 14 is a sectional view taken along line 14—14 of FIG. 11.

FIG. 15 is a detail view of the like-numbered aspect shown in FIG. 14.

FIG. 16 is a side elevational view taken along line 16—16 of FIG. 11.

DETAILED DESCRIPTION

Figure 3:
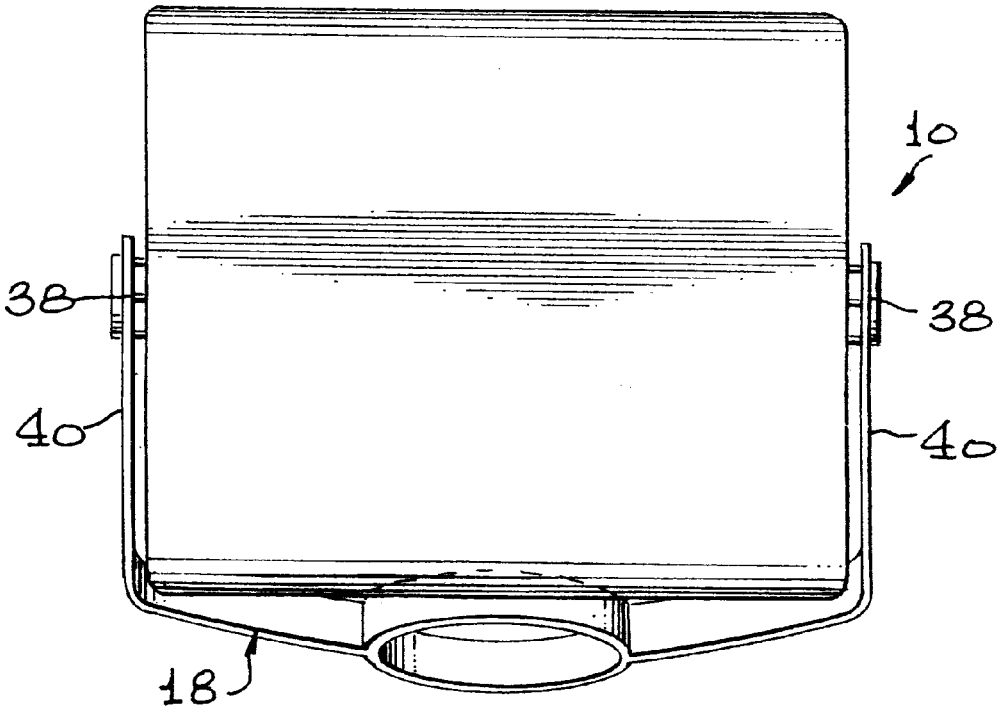
FIG. 3 is a top plan of the embodiment shown in FIG. 1.

With reference now to the drawings, according to one embodiment of the present invention, FIGS. 1–3 shows a transportable carrying case 10 having a main body portion 12, a lid 14, and a bottom portion 16 for receiving a bottom portion of main body portion 12 in nesting relationship. A handle 18 is provided for supporting and carrying the case 10, as well as for locking the lid to the main body portion 12 in the manner to be more fully described below.

Figure 4:
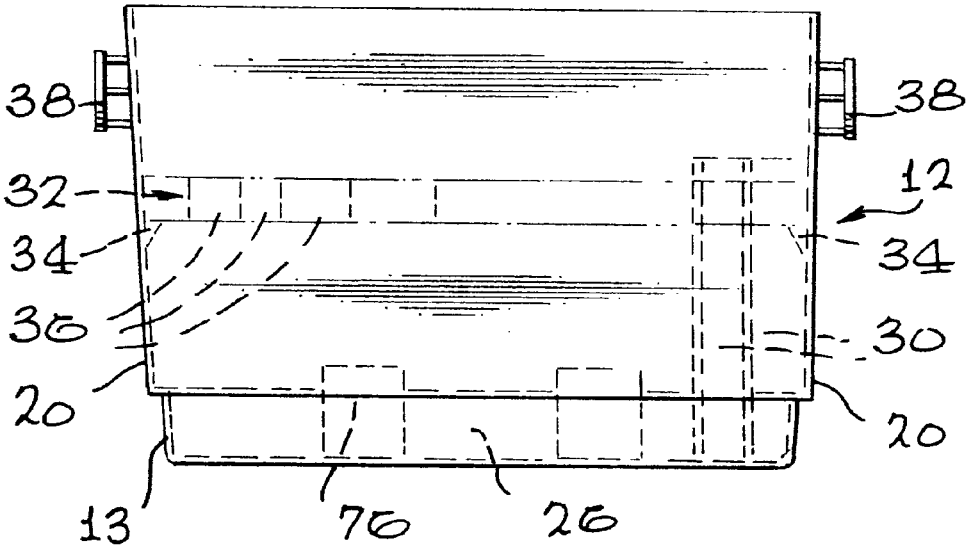
FIG. 4 is a front elevational view of the main body portion of the carrying case shown in FIG. 1.
Figure 5:
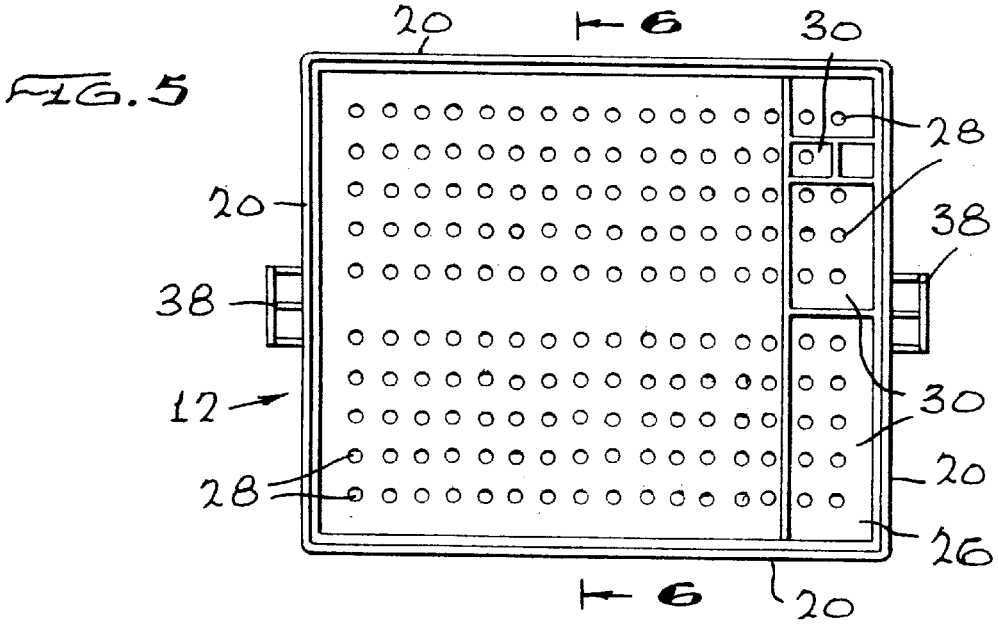
FIG. 5 is a top plan view of the main body portion shown in FIG. 4.
Figure 6:
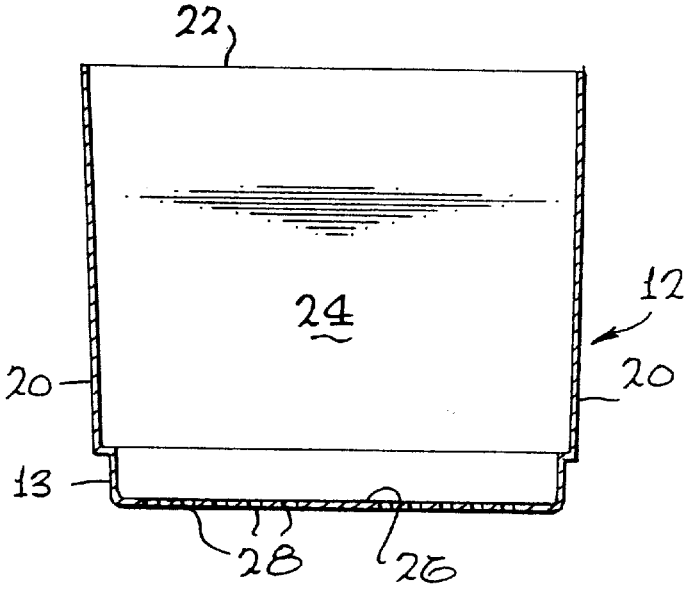
FIG. 6 is a sectional view taken along line 6—6 of FIG. 5.

With reference to FIGS. 4–6, main body portion 12 according to one embodiment includes a plurality of upstanding walls 20 defining a top opening 22 providing access to a cavity 24, and a floor 26. A lower portion 13 of main body portion 12 is reduced in width and depth to accommodate the bottom portion 16 with a contiguous, streamlined shape in the fully assembled condition. It will be understood that walls 20 are contiguously formed between main body portion 12 and lower portion 13. Floor 26 is perforate, with a plurality of openings 28, shown in an evenly spaced array, although it will be apparent to the skilled artisan that other patterns of openings 28 as well as sizes and shapes may be employed to accommodate drainage rates and flows. Openings 28 provide a drainage path for residual moisture or other liquids draining from articles (not shown) being carried or supported within cavity 24. That drainage is received by bottom portion 16 as will be more fully described below. Main body portion 12 further includes one or more receptacles 30 of varying width and length for receiving and retaining personal toiletry articles (not shown). Each receptacle 30 further extends to floor 26, and is contiguous with at least one opening 28 to enable drainage of moisture carried by the article, or to assist in drainage of fluids inadvertently spilled from the article. As will be appreciated by the skilled artisan, each receptacle 30 may be further modified individually or together with other receptacles 30 to receive a specific type of article, family of articles, or otherwise related articles as may be determined, for example, by size or shape. Alternatively, the receptacles may be formed with one or more shoulders or other contours to receive and retain articles in suspension at a preselected depth for uniform accessibility. Yet alternatively, such contours may be employed to receive preselected or uniquely shaped articles in connection with brand-name promotions.

In addition to the receptacles 30 provided for various articles, a shelf 32 may be optionally provided, supported within cavity 24 by a plurality of lips or other protuberances 34 mounted to and extending inwardly from inner surfaces of walls 20. Optionally, the shelf 32 may be configured to complement the existent receptacles 30 by providing a continuous and contiguous article receiving area across the width and/or depth of the main body portion 12 in the installed condition, while being readily removable to provide access to the underlying cavity in which additional articles may be received. The present invention contemplates that such lips or protuberances 34 may be either molded in place or selectively adjustable within corresponding recesses or fixtures (not shown) supported by the walls 20. The shelf 32 includes one or more recesses 36 for receiving and retaining additional articles, some or all of which include drain openings to facilitate drainage to the openings 28 provided in the floor of the main body portion 12. The main body portion 12, as well as the optional shelf 32 and all other components of the invention further described herein are constructed of injection molded polypropylene, although other lightweight but strong materials may be utilized to achieve the objectives of the invention. It is desired that such plastics materials be employed for their chemically inert, non-rotting, and easily-cleaned and sterilized characteristics in view of the hostile environments in which the invention is intended to be used.

Figure 8:
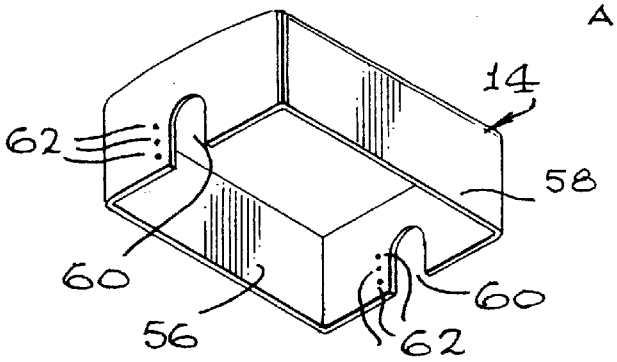
FIG. 8 is a perspective view of the lid of the carrying case shown in FIG. 1.
Figure 7:
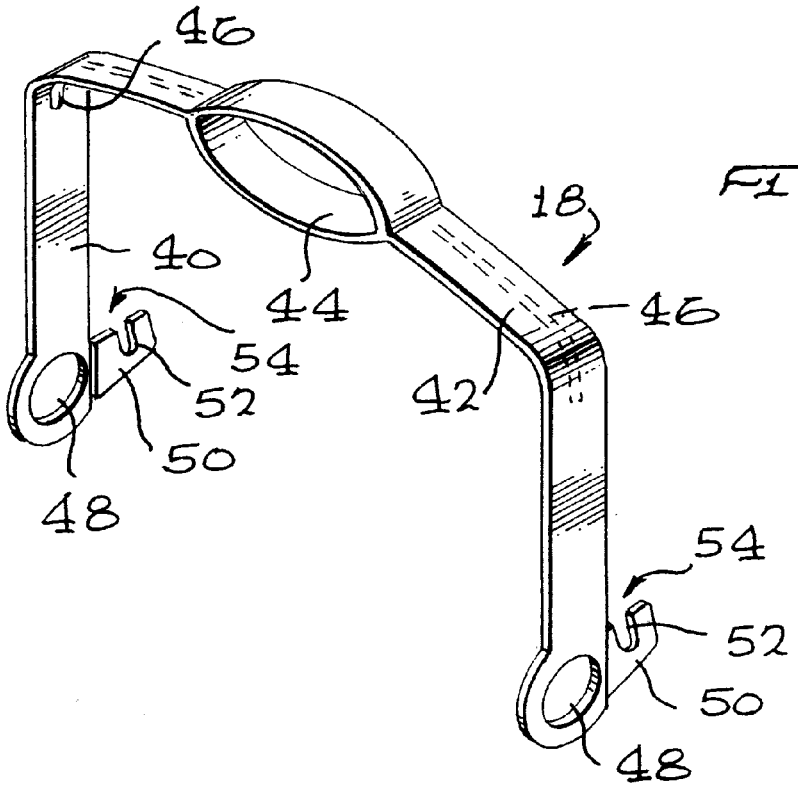
FIG. 7 is a perspective view of the handle of the carrying case shown in FIG. 1.
Figure 10:
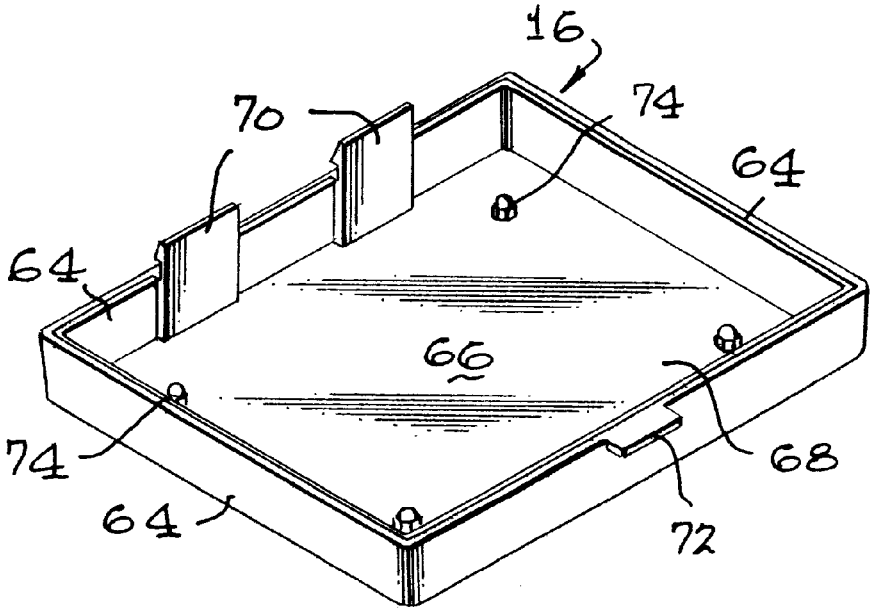
FIG. 10 is a perspective view of the bottom portion of the carrying case shown in FIG. 1.

A pair of hubs 38 are mounted to and extend outwardly from opposite walls of main body portion 12 for supporting for rotation handle 18. With reference to FIG. 7, handle 18 includes a pair of opposing arms 40 bridged by cross-piece 42. A recess 44 is integrally formed at the midpoint of cross-piece 42 for receiving a suspending protrusion selected from the group including a door knob, handle, shower head, and clothing hook. It will be apparent to the skilled artisan that additional recesses 44 may be provided along the length of the cross-piece 42 to provide additional support options, or to distribute the weight of the carrying case over plural suspending protrusions. Additionally, a fillet 46 may be molded in place to provide additional structural rigidity and strength. Knuckles 48 are provided at the opposite ends of arms 40 to be supported by corresponding hubs 38. The handle 18 may be simple affixed to the hubs 38 by simple installing the knuckles 48 over the hubs 38, the U-shaped handle 18 being retained in place by a compression fit therebetween. Extending from and integrally formed with the handle 18 and knuckles 48 are radially extending arms 50 terminating at open hooks 52. The concavity 54 defined by each open hook 52 is generally perpendicular to the arm 40, and engages with prongs or protrusions (FIGS. 8, 9) to be more fully described below.

The lid 14 removably affixed to the top opening 22 of the main body portion 12. Lid 14 includes a plurality of walls 56 joined to a roof 58 shown with a slightly bulbous convexity, although other shapes are contemplated by the present invention as necessary and desired to accommodate articles having extended dimensions. A pair of arcuate shaped recesses 60 are formed in a pair of opposing walls 56 to accommodate hubs 38 when the lid 14 is installed in overlapping relationship with the top opening 22. As will be apparent, and according to the invention, the lid 14 may be engaged with the main body portion 12 in telescoping relationship at a plurality of extensions therefrom, and the arcuate shaped recesses 60 are dimensioned to adequately accommodate the hubs 38 without interference at the fully contracted position.

Figure 9:
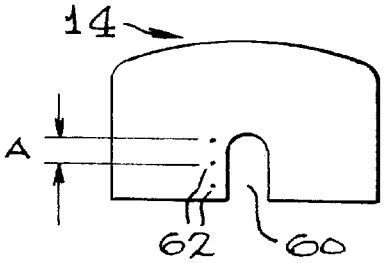
FIG. 9 is a side elevational view of the lid shown in FIG. 8.

A plurality of tabs or protrusions 62 are spaced along wall 56 of the lid adjacent recesses, with a spacing of value A (FIG. 9). With such spacing, each tab 62 defines a telescoped position of the lid 14 relative to the top opening 22 of the main body portion 12. Although three tabs 62 are shown, a greater or lesser number of tabs 62 with equal or unequal spacing (dimension A) therebetween may be selected as required by the nature of the articles to be carried by carrying case 10. In operation, when the handle 18 is rotated in a first direction X (FIG. 1) to lock the lid 14 to the main body portion 12, the pair of hooks 52 engage the corresponding selected pair of tabs 62 to lock the lid 14 in that position. Optionally, in the fully locked position, edge 18*a* slides over and engages with a raised fillet 19 protruding along a longitudinal extent of the main body portion 12, to cause the edge 18*a* to be retained against edge 19*a* in locking engagement. Edge 18*a* may be provided on an upper or lower extending edge of the structural element defining recess 44. It will be apparent to the skilled artisan that other locking arrangements may be provided to provide a suitable secondary locking feature. Rotation of the handle 18 in the opposite direction causes the hooks 52 to disengage from the tab 62 to thereby enable removal of the lid 14 from the main body portion 12, as well as to enable use of the handle 18 for carrying purposes.

With reference now to FIGS. 10–16, there is shown therein a bottom portion 16 for use as a drain pan or reservoir to receive drainage such as moisture or other fluids flowed through openings 28 of main body portion 12. Alternatively, bottom portion 16 may also be used to transport or store wet or dry articles. Bottom portion 16 includes a plurality of walls 64 joined by a floor 66 to form a reservoir cavity 68. A pair of hinges 70 are provided at the upper edge of one wall 64, and a catch 72 extends from an opposite wall 64. A plurality of stand-offs 74 secured to the floor 66 extend upwardly to a generally uniformly height. In use, the lower portion 13 (FIG. 4) of main body portion 12 is received in nesting relationship within bottom portion 16, supported at a predetermined height by stand-offs 74, while allowing hinges 70 to engage in complementary-shaped slots 76 opening upwardly into walls 20 of the main body portion 12 (FIG. 4). When the bottom portion 16 is fully engaged to the main body portion 12, an upper portion of each stand-off 74 is engaged with a snap-fit within a corresponding opening 28 provided in the main body portion 12, while catch 72 engages with a lower lip 78 formed at the lower edge of an opposing wall 20 (FIG. 3). Each hinge 70 may be a "living hinge" that is self-supporting and is sufficiently flexible to engage with but allow for flexibility when the main body portion 12 is articulated to opened and closed positions relative to the bottom portion 16 from time to time to allow for evacuation of accumulated moisture and liquid residue. A spear shaped prong 80 is removably engaged with its corresponding cavity provided in slot 76. Hinges 70 may be formed of an elastomeric material that will withstand harsh environments and rugged usage.

Although particular embodiments of the present invention have been shown and described, modifications may be made to the present invention without departing from the teachings of the present invention. The terms used in describing the invention are used in their descriptive sense and not as terms of limitation, it being intended that all equivalents thereof be included within the scope of the appended claims.

What is claimed is:

1. A carrying case comprising:

a main body portion having a plurality of walls defining a top opening, and a floor having a drain, the main body portion further including;

a bottom portion adapted to be removably affixed to but spaced from the main body portion to define a reservoir between the floor and the bottom portion for receiving and retaining drainage from the main body portion; and a lid adapted to be removably affixed to the top opening of the main body portion;

further including a handle affixed for rotation to the main body portion at a pivot, and a hook supported by the handle offset from the pivot; and a plurality of tabs spaced along a wall of the lid, whereby when the handle is rotated about the pivot in a first direction, the hook engages one of said tabs to lock the lid at a corresponding telescoped position relative to the main body, and when the handle is rotated in a second direction opposite the first direction, the hook disengages the tab.

2. The carrying case of claim 1, wherein the floor of the main body portion is perforate.

3. The carrying case of claim 1, wherein the bottom portion is spaced from the main body portion by at least one spacer.

4. The carrying case of claim 1, wherein the floor is integrally formed with a plurality of drainage perforations and a plurality of standoffs provided between the floor and the bottom portion for spacing the main body portion tom the bottom portion.

5. The carrying case of claim 1, wherein the bottom portion is affixed to the main body portion by a hinge.

6. The carrying case of claim 5, wherein the hinge is a living hinge.

7. The carrying case of claim 1, further comprising a plurality of grooves formed along a wall of the main body, a selected groove receiving in locking engagement a leading edge of the handle when the handle is fully rotated to a locked position.

8. The carrying case of claim 1, wherein the handle is secured to a pair of hubs mounted to opposite walls of the main body portion.

9. The carrying case of claim 1, wherein the handle includes at least one integrally formed recess for suspending the carrying case from a protrusion.

10. The carrying case of claim 1, further comprising a plurality of article or container receiving apertures formed therein.

11. The carrying case of claim 1, further comprising a removable tray being singly and removably receivable within the main body portion, and a drain provided therein.

12. A carrying case comprising:

a main body portion having a top opening, and a perforate floor;

a bottom portion adapted to be affixed to the main body portion for receiving drainage through the perforate floor, the bottom portion spaced from the perforate floor to define a reservoir therebetween;

a lid adapted to be removably affixed to the top opening of the main body portion; and a handle for securing the lid in a closed configuration in one of a plurality of telescoped positions adjacent to the main body portion;

wherein the handle is affixed for rotation to the main body portion at a pivot the handle having a hook supported by the handle offset from the pivot; and a plurality of tabs spaced along a wall of the lid each tab defining a telescoped position of the lid relative to the opening to the main body portion whereby when the handle is rotated in a first direction, the hook engages one of said tabs to lock the lid at a corresponding telescoped position, and when the handle is rotated in a second direction opposite the first direction, the hook disengages the tab to enable removal of the lid from the main body portion.

13. The carrying case of claim 12, wherein the bottom portion is removably affixed to the main body portion.

14. The carrying case of claim 12, wherein the bottom portion is affixed by a binge to the main body portion.

15. The carrying case of claim 14, wherein the hinge is a living hinge.

16. The carrying case of claim 12, further comprising a plurality of grooves formed along a wall of the main body, a selected groove receiving in locking engagement a leading edge of the handle when the handle is fully rotated to a locked position.

17. The carrying case of claim 12, wherein the handle portion is secured to a pair of hubs mounted to opposite walls of the main body portion.

18. The carrying case of claim 12, wherein the portion includes at least one suspending-arm receiving recess for suspending the carrying case.

19. The carrying case of claim 18, wherein the suspending-arm receiving recess is adapted to receive a suspending protrusion selected from the group consisting of a door knob, handle, shower head, and clothing hook.

20. The carrying case of claim 12, further comprising a removable tray being singly and removably receivable within the main body portion, and a drain provided therein.

21. A carrying case comprising:

a main body portion having a wall defining a top opening and supporting a base, and a perforate floor provided in the base;

a bottom portion having an imperforate floor adapted to receive in nesting relationship the base of the main body portion, the perforate floor spaced above the imperforate floor to define a reservoir therebetween for receiving drainage through the perforate floor;

a lid removably affixed to the top opening of the main body portion; and a handle secured for articulation to the main body portion, the handle including a gripping device for gripping one of a plurality of securement points provided on the lid, for securing the lid in a closed configuration in one of a plurality of telescoped positions relative to the top opening when the handle is articulated to a secured position.

22. The carrying case of claim 21, wherein the perforate floor is integrally formed in the base.

23. The carrying case of claim 21, wherein the bottom portion is secured to the main body portion with a water-tight seal.

24. The carrying case of claim 21, wherein the bottom portion is spaced from the main body portion by at least one spacer.

25. The carrying case of claim 21, wherein the lid is hingedly affixed to the main body portion.

26. The carrying case of claim 21, further including at least one receptacle formed in the interior of the main body portion for receiving a personal article, the receptacle including a drain.

27. The carrying case of claim 21, wherein the gripping device is a hook, and the securement points are tabs.

28. The carrying case of claim 21, wherein the handle includes at least one suspending-arm receiving recess for suspending the carrying case.

29. The carrying case of claim 28, wherein the suspending-arm receiving recess is adapted to receive a suspending protrusion selected from the group including a door knob, handle, shower head, and clothing hook.

30. The carrying case of claim 21, further comprising a removable tray being singly and removably receivable within the main body portion, and a drain provided therein.

31. The carrying case of claim 24, wherein the spacer removably engages with a perforation of the perforate floor.

* * * * *